United States Patent [19]

Daumüller et al.

[11] Patent Number: 4,642,739

[45] Date of Patent: Feb. 10, 1987

[54] BULB ASSEMBLY FOR A VEHICLE HEADLIGHT

[75] Inventors: Hans Daumüller, Bodelshausen; Walter Weber, Weil der Stadt, both of Fed. Rep. of Germany

[73] Assignee: Robert Bosch GmbH, Stuttgart, Fed. Rep. of Germany

[21] Appl. No.: 713,261

[22] Filed: Mar. 18, 1985

[30] Foreign Application Priority Data

Jul. 20, 1984 [DE] Fed. Rep. of Germany ..... 3426712

[51] Int. Cl.[4] ..... H01R 33/00

[52] U.S. Cl. ..... 362/226; 362/267; 362/443; 313/318

[58] Field of Search ..... 362/61, 80, 82, 83, 362/226, 267, 378, 433, 435, 437, 443, 296, 310; 313/318, 113

[56] References Cited

U.S. PATENT DOCUMENTS

| | | | |
|---|---|---|---|
| 3,809,880 | 5/1974 | Daumueller et al. | 362/297 |
| 4,412,273 | 10/1983 | Helbig et al. | 362/267 |
| 4,507,712 | 3/1985 | Dolan et al. | 362/80 |

*Primary Examiner*—Charles J. Myhre
*Assistant Examiner*—David A. Okonsky
*Attorney, Agent, or Firm*—Michael J. Striker

[57] ABSTRACT

In a bulb assembly of a vehicle headlight the bulb has a socket formed with an outer annular groove which conically converges towards a filament positioned in a lower portion of the bulb. An O-ring inserted into the groove seals the bulb against a headlight reflector in assembly. The width of the groove in the axial direction of the bulb is selected so that upon pulling the bulb out from the reflector the O-ring performs a rolling motion so that a required pulling force is substantially reduced and a danger for a user injury is prevented.

2 Claims, 3 Drawing Figures

BULB ASSEMBLY FOR A VEHICLE HEADLIGHT

BACKGROUND OF THE INVENTION

The present invention relates to a searchlight or headlight for motor vehicles.

More particularly the invention relates to a bulb assembly for a vehicle headlight.

Vehicle headlights with sealing arrangements for sealing a bulb against a reflector of the headlight have been disclosed, for example in Applicant's U.S. Pat. Nos. 3,809,880 and 3,689,103. Often a sealing O-ring is inserted into an annular groove provided in the outer peripheral surface of the socket of the bulb. The width of the annular groove, or its size in the axial direction of the bulb is insignificantly greater than the diameter of the O-ring positioned in the groove. When the bulb is inserted into the lamp holder provided on the reflector of the headlight and also when the bulb is pulled out from the lamp holder the O-ring shifts along the inner surface of the lamp holder; a plug-in force or a pulling-out force required for these actions is about 40 Newton.

The pulling-out of the bulb from the lamp holder usually takes place in a jerky manner so that a danger of injury due to a narrow space in a pulling-out region behind the headlight is not excluded. This injury danger becomes greater the longer is the bulb in use because the O-ring can bake together with the inner surface of the lamp holder and particularly with the base of the groove, and the pulling-out force must be then many times greater.

SUMMARY OF THE INVENTION

It is an object of the present invention to provide an improved motor vehicle headlight.

It is another object of this invention to provide a bulb assembly in which a small force would be required for pulling out the bulb from the lamp holder of the reflector even if the bulb was in operation for a long time.

It is yet another object of this invention to provide a bulb assembly in the use of which injury danger during the pulling out of the bulb from the reflector would be practically precluded.

These and other objects of the invention are attained by a bulb assembly for a vehicle headlight, comprising a reflector having a sleeve-shaped lamp holder; a bulb insertable into said lamp holder and including a housing receiving a filament and having an end portion, and a socket of insulating material, in which said housing is secured, said socket having a peripheral surface and being formed at said surface with an annular groove; and an O-ring received in said groove, said groove having a base, said lamp holder having an inner surface, said O-ring in assembly abutting against said base and also against said inner surface so as to seal said bulb against said reflector, said groove having in a direction of an axis of said reflector a width, said width being selected so that upon pulling said bulb out from said lamp holder said O-ring executes a rolling motion.

The groove may be conical and converge towards the filament of the bulb. The conical groove ensures a free and safe pulling of the bulb from the headlight reflector.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DETAILED DESCRIPTION OF THE PREFERRED EMBODIMENTS

Figure 1:
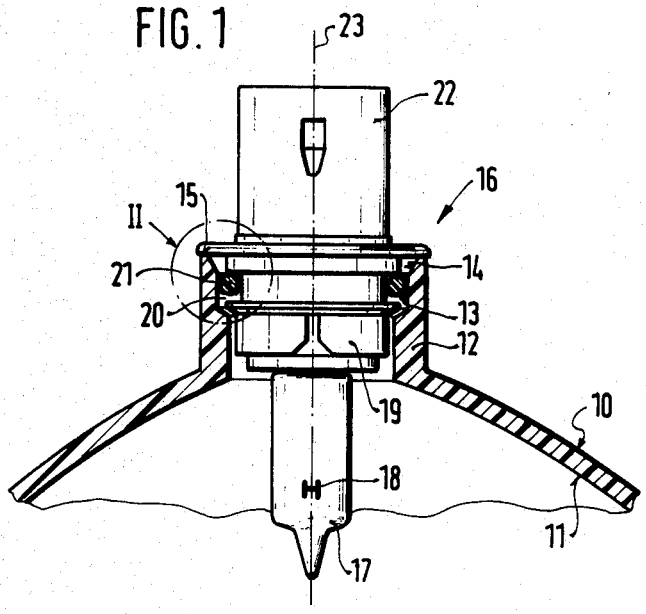
FIG. 1 is a side sectional view of a reflector, with a bulb inserted therein, of a vehicle headlight, on a natural scale.

FIG. 1 illustrates a vehicle headlight in portion. The vehicle headlight includes a reflector 10 of plastics and having a reflection coating 11, and a lamp holder 12. The latter has a cylindrical inner periphery or surface 13 which merges into a conical enlarged surface 14 which in turn terminates at a rim 15 of the lamp holder.

A bulb 16 substantially includes a housing 17 in which a light filament 18 is inserted. The end portion of housing 17 is secured in a socket 19 made of insulating material. The peripheral surface of socket 19 has an annular groove 20 which is rectangular in cross-section. An O-ring 21 is inserted in groove 20. Socket 19 is made in one piece with a plug portion 22. The bulb 16 and reflector 10 have a common axis 23.

Figure 2:
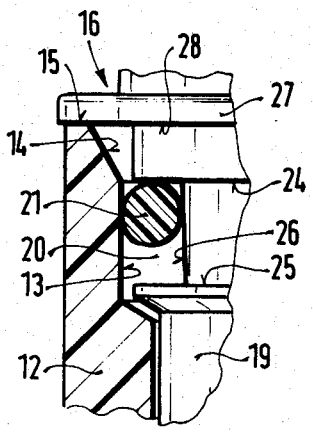
FIG. 2 is a sectional view of a detail 11 of FIG. 1, on enlarged scale; an FIG. 3 is a sectional view similar to that of FIG. 2 but with the bulb pulled out from a lamp holder.
Figure 3:
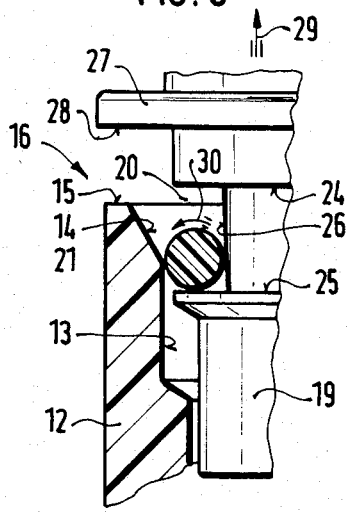

FIG. 2 illustrates a part of the glow lamp inserted into reflector 10 while FIG. 3 shows the same part of the bulb 16 which is partially pulled out from the reflector 10. The annular groove 20 has two parallel flanks 24, 25 which are positioned at right angles to axis 23. Both flanks 24 and 25 are connected to each other by a base 26 of the groove. Base 26 is conical and narrows in the direction towards filament 18. Socket 19 further has an outer flange 27 having a radial shoulder 28.

When the lamp 16 is in its inserted position O-ring 21 lies as an annular ring against the inner surface 13 of the lamp holder 12 and also against base 26 formed by the outer surface of the socket. O-ring 21 thereby effects sealing of the bulb socket relative to reflector 10. Upon pulling the bulb out from the reflector, that is from lamp holder 12, in the direction of arrow 29 in FIG. 3 the O-ring 21 executes a rolling motion in the direction of arrow 30. Thereby the length of the pulling-out stroke of the bulb will determine the width or the extension in the direction of axis 23 of the annular groove 20. The conical converging of base 26 of groove 20 facilitates pulling of the lamp 16 out from reflector 10.

Upon the insertion of bulb 16 into reflector 10 in the direction counter to that of arrow 29 the O-ring 21 performs a rolling motion in the direction opposite to that of arrow 30. The inserted position is attained when the shoulder 28 of outer flange 27 of bulb 16 comes into contact with the rim 15 of lamp holder 12.

It will be understood that each of the elements described above, or two or more together, may also find a useful application in other types of vehicle headlights differing from the types described above.

While the invention has been illustrated and described as embodied in a vehicle headlight, it is not intended to be limited to the details shown, since various modifications and a structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A bulb assembly for a vehicle headlight, comprising a reflector having a sleeve-shaped lamp holder; a bulb insertable into said lamp holder and including a housing receiving a filament, a plug portion having an end portion and a socket of insulating material in which said housing is inserted at said end portion, said socket having a peripheral surface and being formed at said surface with an annular groove; and an O-ring received in said groove, said groove having a base, said lamp holder having an inner surface encircling said socket and O-ring, said O-ring in assembly abutting against said base and also adjacent said inner surface so as to seal said bulb against said reflector, said groove extending in a direction of an axis of said reflector by a predetermined distance and said inner surface also extending in said direction by a predetermined distance, the predetermined distance of extension of said groove and said inner surface being selected so that upon pulling said socket out from said lamp holder in said direction said O-ring is in contact only with said inner surface and said base such that said O-ring executes a rolling motion.

2. The assembly as defined in claim 1, wherein said base being conical relative to said inner surface and converging in said direction towards the filament of the bulb.

* * * * *